US009205428B2

(12) United States Patent
Huang et al.

(10) Patent No.: US 9,205,428 B2
(45) Date of Patent: Dec. 8, 2015

(54) RUBBING MACHINE AND ITS TOOL PAN

(75) Inventors: Rui-Zhi Huang, Taiwan (CN); Sheng-Chien Lin, Taiwan (CN)

(73) Assignee: YFY BIOPULP TECHNOLOGY LIMITED, Tortola (VG)

( * ) Notice: Subject to any disclaimer, the term of this patent is extended or adjusted under 35 U.S.C. 154(b) by 64 days.

(21) Appl. No.: 14/006,693

(22) PCT Filed: Mar. 23, 2011

(86) PCT No.: PCT/CN2011/000487

§ 371 (c)(1),
(2), (4) Date: Dec. 2, 2013

(87) PCT Pub. No.: WO2012/126142

PCT Pub. Date: Sep. 27, 2012

(65) Prior Publication Data

US 2014/0077015 A1 Mar. 20, 2014

(51) Int. Cl.

| | |
|---|---|
| ***B02C 7/12*** | (2006.01) |
| ***B02C 7/04*** | (2006.01) |
| ***B02C 7/06*** | (2006.01) |
| ***D21D 1/30*** | (2006.01) |

(52) U.S. Cl.
CPC ... *B02C 7/12* (2013.01); *B02C 7/04* (2013.01); *B02C 7/06* (2013.01); *D21D 1/306* (2013.01)

(58) Field of Classification Search
CPC ..... D21D 1/30; D21D 1/306; D21D 1/303; B02C 7/06; B02C 7/12; B02C 7/04
USPC ..... 241/247, 261.2, 261.3, 296, 297, 298
See application file for complete search history.

(56) References Cited

U.S. PATENT DOCUMENTS

| | | | | |
|---|---|---|---|---|
| 827,059 | A | 7/1906 | Davis | |
| 845,721 | A | 2/1907 | Sovereign | |
| 938,798 | A | 11/1909 | Sovereign | |
| 3,040,997 | A * | 6/1962 | Borden | 241/261.3 |
| 5,362,003 | A * | 11/1994 | Virving | 241/261.3 |
| 5,704,559 | A | 1/1998 | Fröberg et al. | |

(Continued)

FOREIGN PATENT DOCUMENTS

| | | | |
|---|---|---|---|
| CN | 1391501 | A | 1/2003 |
| CN | 1786336 | A | 6/2006 |

(Continued)

OTHER PUBLICATIONS

Corresponding International Application No. PCT/CN2011/000487 Search Report dated Jan. 5, 2012.

(Continued)

*Primary Examiner* — Faye Francis
*Assistant Examiner* — Onekki Jolly
(74) *Attorney, Agent, or Firm* — Hauptman Ham, LLP

(57) ABSTRACT

A tool pan has a number of homocentric annular structures which have rubbing zones. Provided between the contiguous rubbing zones is at least a ramp, which is extending along the normal of the tool pan, and the height of which is increased gradually towards the fringe of the tool pan. In a rubbing machine the tool pan is used. The rubbing machine is applicable in paper making industry, and can effectively separate and fibrillate the fiber of herbage by mechanical force between a pair of tool pans, thereby needing not to use chemicals, and according with the modern conception of environmental protection.

7 Claims, 7 Drawing Sheets

(56) References Cited

U.S. PATENT DOCUMENTS

| | | | | |
|---|---|---|---|---|
| 6,422,496 | B1 | 7/2002 | Doelle | |
| 6,616,078 | B1 * | 9/2003 | Gingras | 241/261.2 |
| 2002/0070303 | A1 * | 6/2002 | Johansson et al. | 241/261.3 |
| 2002/0185560 | A1 * | 12/2002 | Johansson | 241/298 |
| 2006/0151648 | A1 * | 7/2006 | Vuorio et al. | 241/261.2 |
| 2007/0158483 | A1 * | 7/2007 | Gingras | 241/296 |
| 2007/0205314 | A1 * | 9/2007 | Gingras | 241/261.3 |
| 2007/0210197 | A1 * | 9/2007 | Carpenter | 241/298 |
| 2009/0145990 | A1 * | 6/2009 | Vuorio | 241/261.3 |

FOREIGN PATENT DOCUMENTS

| | | | |
|---|---|---|---|
| CN | 101481887 | A | 7/2009 |
| DE | 10 2008 059 610 | A1 | 6/2010 |
| EP | 0 417 063 | A2 | 3/1991 |
| TW | 396809 | | 7/2000 |
| TW | 529458 | | 4/2003 |
| WO | 91/07228 | A1 | 5/1991 |
| WO | 02064259 | A1 | 8/2002 |
| WO | 2009/068739 | A1 | 6/2009 |

OTHER PUBLICATIONS

CN Application No. 201180069382.8, Office Action mailed Aug. 20, 2014.

EP Application No. 11 86 1353.8, Search Report mailed Oct. 20, 2014.

Office Action in corresponding Taiwan Application No. 101109662 dated Feb. 19, 2014, 5 pages.

* cited by examiner

RUBBING MACHINE AND ITS TOOL PAN

RELATED APPLICATIONS

The present application is based on, and claims priority from International Application Number PCT/CN2011/000487, filed Mar. 23, 2011, the disclosure of which is hereby incorporated by reference herein in its entirety.

BACKGROUND OF THE INVENTION

1. Field of the Invention

The present invention relates to a rubbing machine, and more particularly, to a rubbing machine capable of separating and fibrillating fibers of herbage and a tool pan thereof.

2. Descriptions of the Related Art

Ecological materials can be easily obtained from the nature without the concern of shortage in supply. Use of the ecological materials can reduce the dependence on resources to reduce the resource consumption and can eliminate the need of developing new kinds of resources, so great importance has been attached to use of the ecological materials. Correspondingly, extracting ecological materials from plants and transforming the ecological materials into new kinds of industrial products has become an important trend. Among such ecological materials, ecological fibers are known as a very important kind.

Natural plant fibers have been used in industries related to paper making, textiles, building, construction and so on. Currently, fibers used in China are mainly wood fibers. However, because of the exceeding deforestation of forests and the increased demand of reducing the exhaust of greenhouse gases, replacing the wood fibers with plant fibers (e.g., bamboo fibers, rice straw fibers, wheat straw fibers and so on) that are abundant in China will create more economical benefits.

To satisfy the demands for ecological fibers, a fiber separating technology that has a high efficiency and is environmentally friendly must be developed. Conventional fiber separating methods include chemical separating methods and steam explosion separating methods. According to the chemical separating methods, chemicals such as alkaline solutions are used to separate the fibers. However, the separating process produces a great amount of pollutants which are unfavorable for environmental protection, and the fibers are largely damaged by the chemicals, so the fiber yield is as low as about 40~50%. Furthermore, if the fibers separated by using the chemicals are to be used in food containers, the fibers must be cleaned to remove the chemicals completely, and this increases the processing cost. For the steam explosion methods, repeated cycles of rapidly decreasing and increasing the steam pressure are carried out to separate the fibers through explosion, and this is both time and energy consuming and delivers poor uniformity of fibers.

SUMMARY OF THE INVENTION

In view of this, the present invention provides a rubbing machine that can separate plant fibers without using chemicals.

The present invention further provides a tool pan that can improve the separating rate of plant fibers.

A rubbing machine disclosed in the present invention comprises a housing, a tool pan assembly and a driving element. The housing has a feeding inlet and a discharging outlet. The tool pan assembly is disposed inside the housing and comprises two tool pans that are spaced apart by an interval to form a rubbing space that interconnects between the feeding inlet and the discharging outlet. Each of the tool pans comprises a plurality of homocentric annular structures. Each of the homocentric annular structures has a plurality of rubbing zones, and at least one ramp is disposed between adjacent rubbing zones. Each of the ramps extends along a normal direction of the tool pan corresponding to the ramp and ramps up gradually towards a fringe of the corresponding tool pan. The driving element is connected with one of the tool pans to drive the tool pan to rotate relative to the other of the tool pans.

The tool pan disclosed in the present invention comprises a plurality of homocentric annular structures. Each of the homocentric annular structures has a plurality of rubbing zones, and at least one ramp is disposed between adjacent rubbing zones. Each of the ramps extends along a normal direction of the tool pan and ramps up gradually towards a fringe of the tool pan.

In an embodiment of the present invention, the rubbing machine further comprises a material-guiding screw, and one of the two tool pans has a material-guiding hole substantially located at a center of the tool pan, and the material-guiding screw is inserted into the material-guiding hole.

In an embodiment of the present invention, each of the ramps near the fringe of the tool pan has a width that is smaller than which at positions away from the fringe of the tool pan.

In an embodiment of the present invention, a plurality of ramps may be disposed between adjacent ones of the rubbing zones, and the ramps are arranged in a normal direction of the tool pan.

In an embodiment of the present invention, each of the rubbing zones has a front end facing towards a direction in which the tool pans rotate relative to each other, and the front end has a chamfer.

The tool pan of the rubbing machine of the present invention has ramps that are formed into a plurality of circles. In this way, the material to be rubbed can move between opposite rubbing zones along the ramps so that the material can be rubbed by the alternating forces between the two tool pans. As can be known from this, the rubbing machine of the present invention is applicable to the paper manufacturing industry where the fibers of herbage can be separated or fibrillated effectively by the mechanical force between the two tool pans. Thereby, it is unnecessary to use chemicals and this complies with the modern conception of environmental protection.

What described above is only a summary of technical solutions of the present invention. In order to provide a better understanding of the technical means of the present invention so that the present invention can be practiced according to the present disclosure and in order to make the aforesaid and other objectives, features and advantages of the present invention clearer, preferred embodiments will be described hereinbelow with reference to the attached drawings.

DESCRIPTION OF THE PREFERRED EMBODIMENT

To further describe the technical means adopted by the present invention to achieve the predetermined objectives and the efficacies thereof, implementations, structures, features and efficacies of the rubbing machine and the tool pan thereof according to the present invention will be detailed as follows with reference to the attached drawings and the preferred embodiments.

Figure 1:
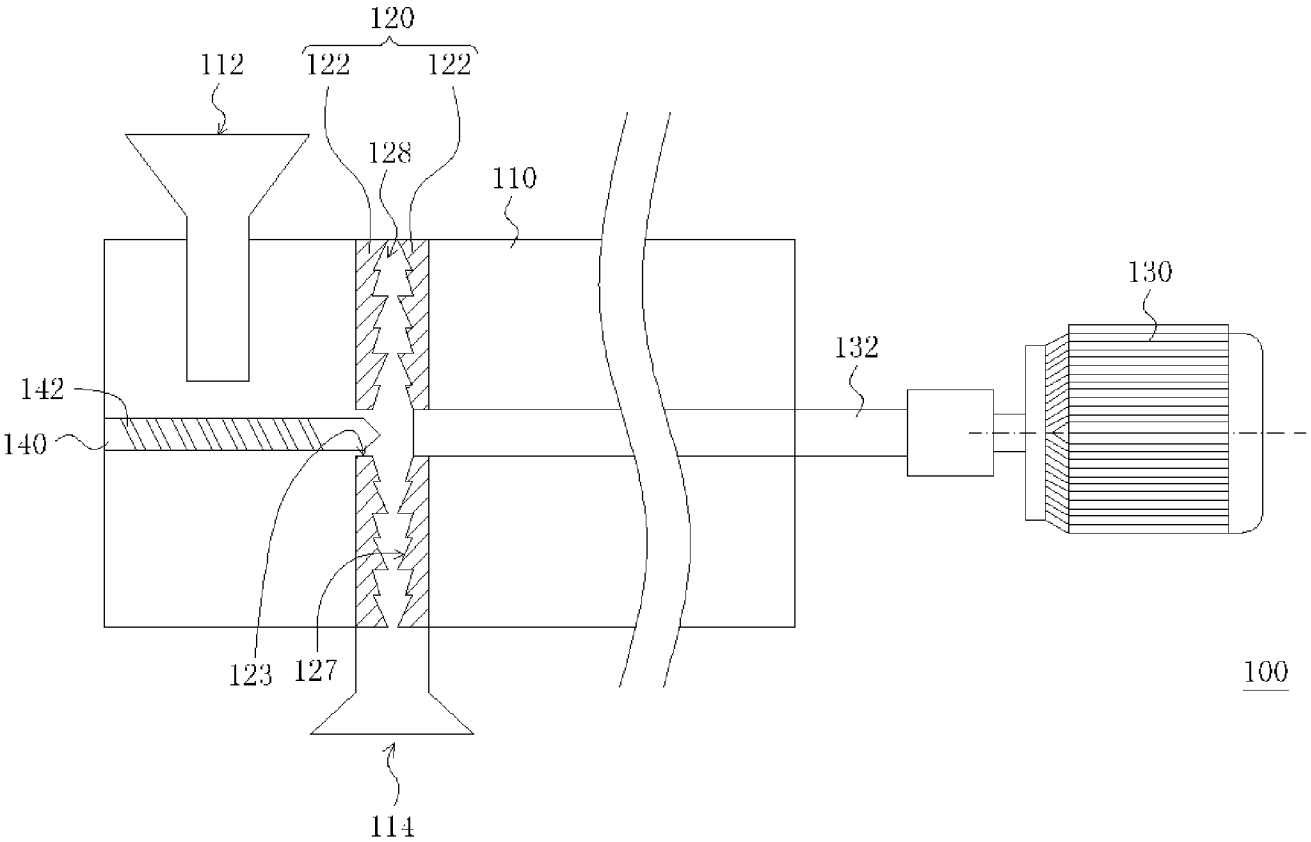
FIG. 1 is a schematic cross-sectional view of a rubbing machine according to an embodiment of the present invention.
Figure 2:
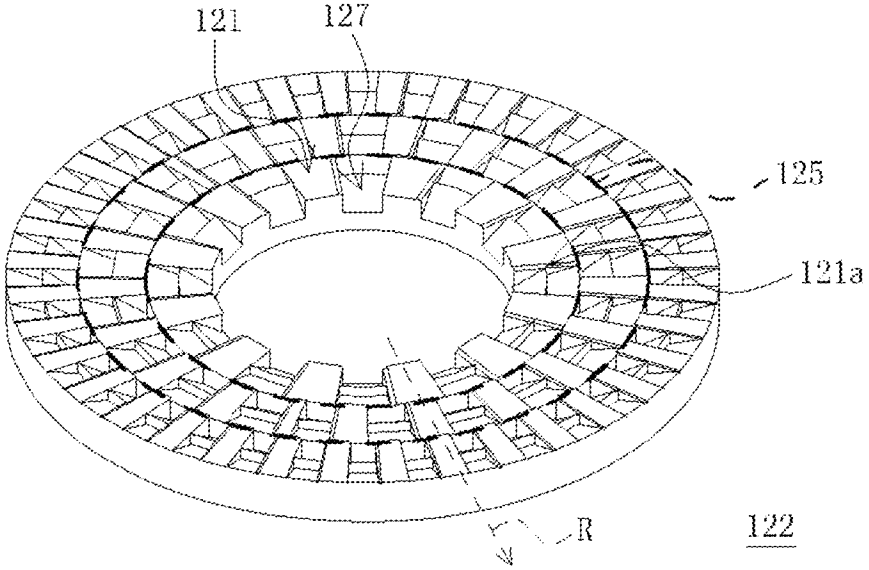
FIG. 2 is a schematic view of a tool pan according to an embodiment of the present invention.

FIG. 1 is a schematic cross-sectional view of a rubbing machine according to an embodiment of the present invention, and FIG. 2 is a schematic view of a tool pan according to an embodiment of the present invention. Referring to FIG. 1 and FIG. 2, a rubbing machine 100 comprises a housing 110, a tool pan assembly 120 and a driving element 130. The housing 110 has a feeding inlet 112 and a discharging outlet 114. The tool pan assembly 120 is disposed inside the housing 110 and comprises two tool pans 122. The two tool pans 122 are spaced apart by an interval to form a rubbing space 128 that interconnects with the feeding inlet 112 and the discharging outlet 114 between the feeding inlet 112 and the discharging outlet 114.

Further, each of the tool pans 122 comprises a plurality of homocentric annular structures 125. Each of the homocentric annular structures 125 has a plurality of rubbing zones 121, and at least one ramp 127 is disposed between adjacent rubbing zones 121. Each of the ramps 127 extends along a normal direction R of the tool pan 122 corresponding to the ramp and ramps up gradually towards a fringe of the corresponding tool pan 122. In this embodiment, there are, for example, two ramps 127 arranged along the normal direction R of the tool pan 122 between every two adjacent rubbing zones 121 of each of the annular structures 125.

It shall be noted that, in other embodiments, there may also be more than two ramps 127 disposed between every two adjacent rubbing zones 121 of each annular structure 125, and the number of ramps 127 disposed between every two adjacent rubbing zones 121 is not limited in the present invention.

Particularly, each of the rubbing zones 121 may also have a chamfer 121*a* located at a front end of the rubbing zone 121. Here, the terms "front" and "back" are defined with respect to a relative rotation direction of the tool pans 122. That is, the chamfer 121*a* is located in the front with respect of the relative rotation direction of the tool pan 121*a*.

Furthermore, the rubbing zones 121 of the annular structures 125 in different annuli may be spaced apart by different intervals respectively in this embodiment. In other words, the ramps 127 of the annular structures 125 in different annuli may have different widths respectively. In this embodiment, the ramps 127 nearer to a fringe of the tool pans 122 have smaller widths. The ramp depth of each ramp into the tool pan 122 increases radially inward between adjacent rubbing zones 121 in the same homocentric annular structure, and the width of the ramps is gradually smaller from an inner homocentric annular structure to an outer homocentric annular structure.

In this embodiment, only one of the two tool pans 122 rotates relative to the housing 110 while the other remains stationary when the rubbing machine 100 operates. However, the present invention is not limited to this; and in other embodiments, both the tool pans 122 can rotate relative to the housing 110 but rotate at speeds different from each other so that a relative movement takes place therebetween.

In this embodiment, the tool pan 122 that can rotate relative to the housing 110 is connected with a rotary shaft 132 of the driving element 130 so as to be rotated by the driving element 130. Specifically, the driving element 130 is a motor. On the other hand, the tool pan 122 that is stationary relative to the housing 110 may have a material-guiding hole 123 located substantially at a center of the tool pan 122 and communicating with the feeding inlet 112. Moreover, the material to be rubbed that is fed from the feeding inlet 112 is transported into the rubbing zones 128 between the two tool pans 122 by use of a material-guiding screw 140 in this embodiment. To be more specific, the material-guiding screw 140 is inserted through the material-guiding hole 123 of the tool pan 122 and located below the feeding inlet 112 of the housing 110.

The rubbing machine of the present invention is applicable to the process of making paper pulp from plant fibers. To facilitate better understanding of the present invention by those skilled in the art, an application of the rubbing machine of the present invention will be described with reference to an embodiment thereof.

Figure 3:
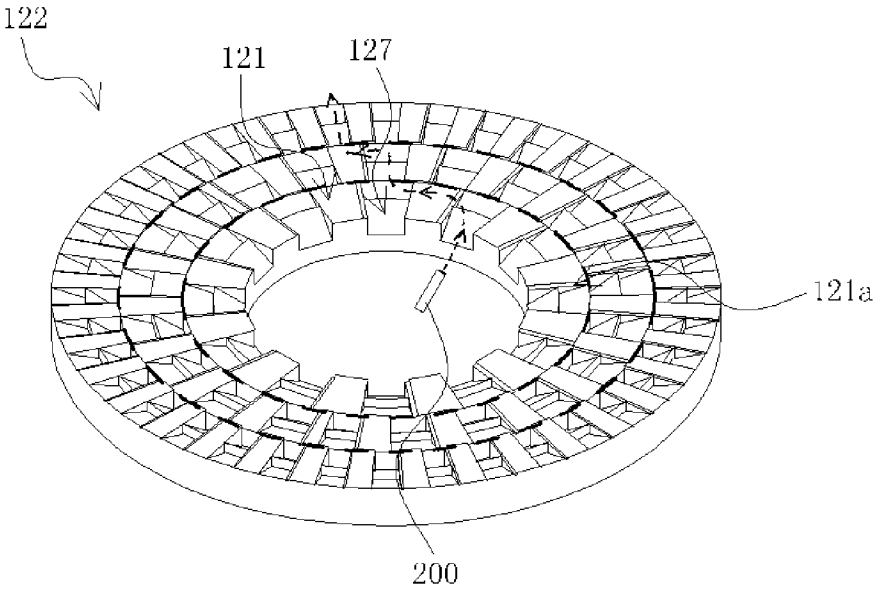
FIG. 3 is a schematic view illustrating a movement path of straws in the rubbing machine.

FIG. 3 is a schematic view illustrating a movement path of a straw between the two tool pans. Referring to FIG. 1 through FIG. 3, a straw of a herbaceous plant (e.g., a rice straw or a wheat straw) is obtained and processed by a pulper machine (not shown) to remove skins of the straw through vibration, and are then put into the feeding inlet 112. Meanwhile, water is injected through the feeding inlet 112. The straw then falls into spaces between threads 142 of the material-guiding screw 140 and, accompanying with the flowing water, is transported by the rotating material-guiding screw 140 from the material-guiding hole 123 to the rubbing spaces 128 between the two tool pans 122; and then under the action of a water flow caused by the centrifugal force resulting from rotation of the tool pan 122, the straw is moved outwards radially to the ramps 127. In this embodiment, the tool pan 122 shown in FIG. 3 rotates in, for example, a clockwise direction, so the straw 200 moves outwards in a radial direction relative to the tool pan 122 but also in a slightly leftward direction.

Figure 4A:
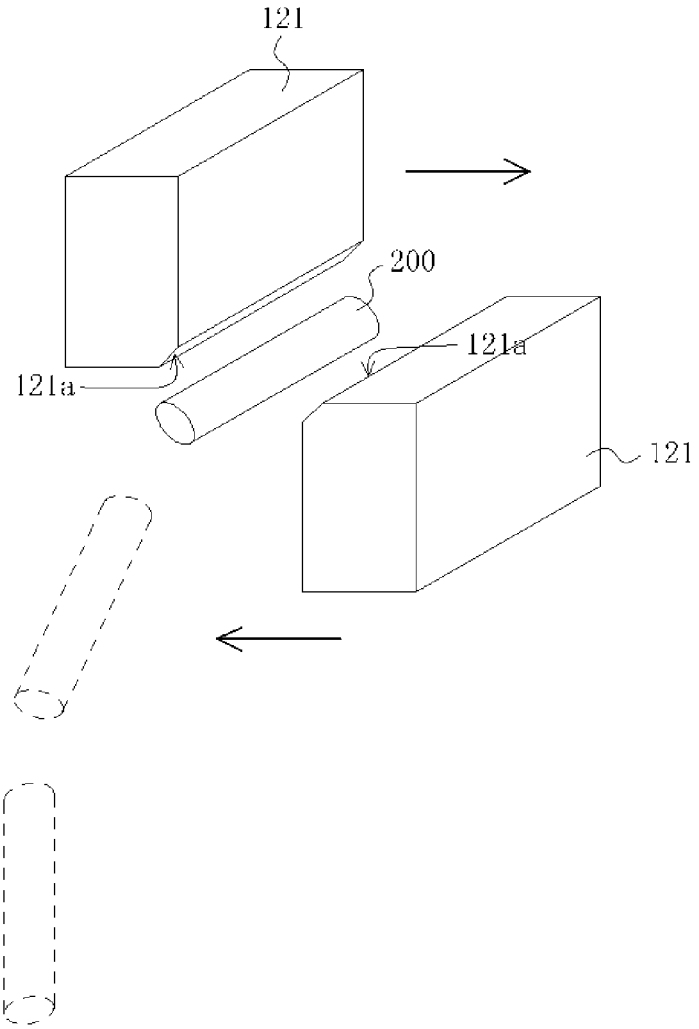
FIGS. 4A through 4D are schematic views depicting how ramps impose forces on the straws.

FIGS. 4A through 4D are schematic views depicting how the rubbing zones impose forces on the straws. Referring to FIG. 3 and FIG. 4A together, the straw 200 moves upwards along the ramps 127 under the action of the water flow. Because of the continuous relative rotation between the two tool pans 122, the rubbing zones 121 of the two tool pans 121 move in directions indicated by the arrows in FIG. 4A respectively. Therefore, a force is applied to the straw 200 by the chamfers 121*a* located at the front ends of the rubbing zones 121 so that the straw 200 is pressed to move towards surfaces of the rubbing zones 121.

Figure 4B:
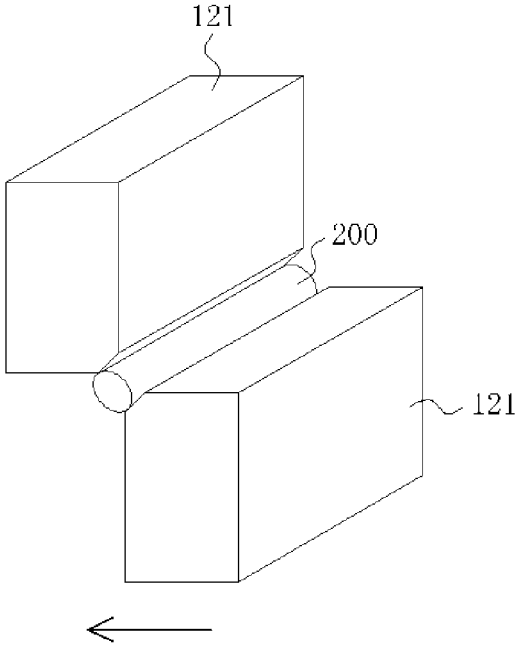

Next, as shown in FIG. 4B, the rotation of the tool pan 122 drives the straw 200 into between chamfers 121*a* located at the front ends of the rubbing zones 121 opposite to each other.

Figure 4C:
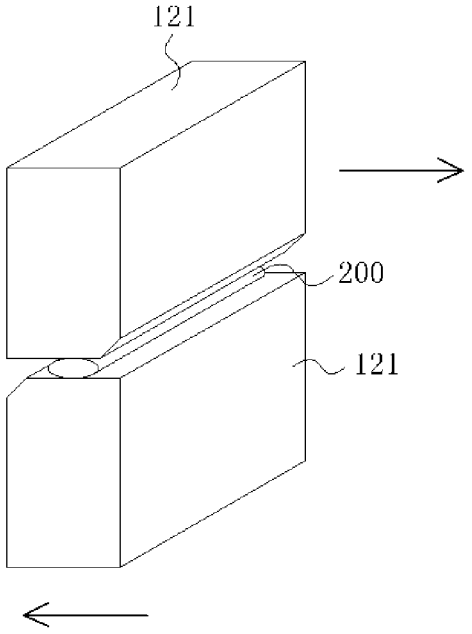

Then as shown in FIG. 4C, with the continuous rotation of the tool pan 122, the straw 200 is moved into between the opposite rubbing zones 121 by the chamfers 121*a*. At this point, because a gap between the opposite rubbing zones 121 is smaller than an original diameter of the straw 200, a rubbing force is applied to the straw 200.

Figure 4D:
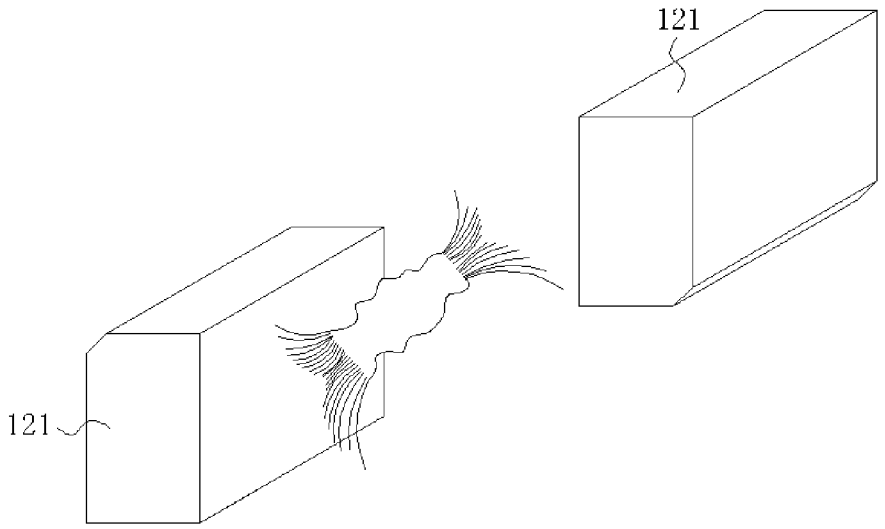

As shown in FIG. 3 and FIG. 4D, as the rubbing zones 121 of the two tool pans 122 move away from each other, the straw 200 moves out of the rubbing zones 121 into a next ramp 127 where the a fiber explosion phenomenon takes place due to an instantaneous vacuum effect. Thereby, the so-called separating or fibrillating of fibers can be achieved.

For example, if an individual straw originally put into the rubbing machine is a fiber bundle consisting of multiple fine fibers, the straw can be separated into multiple fine fibers through the aforesaid process and this is just the so-called fiber separating. Moreover, if the straw originally put into the rubbing machine has already been separated into individual fine fibers, then the aforesaid process can have finer fibrils on the skin of the straw warped up and this is just the so-called fibrillating. The fibrillating is favorable for improving the intertwining force between fibers in the paper pulp to enhance the strength and toughness of the resulting paper.

Taking the separating process as an example, the rubbing machine 10 of the present invention may also improve the fiber separating rate of each rubbing process by means of ramps 127 of different widths. In detail, as shown in FIG. 3, the original straw 200 floats up along a bottom surface of the ramp 127 of the innermost circle to a space between rubbing zones 121 of the two tool pans 122 where it is separated into fine fibers. Then, the fibers float up along a bottom surface of the ramp 127 of a next circle to a space between rubbing zones 121 of the two tool pans 122 where they are separated into finer fibers. In this way, by floating up along bottom surfaces of the ramps 127 of the different cycles to the spaces between the rubbing zones 121 of the two tool pans 122 repeatedly, the fiber separating rate of the straw can reach as high as 95%. Finally, a resulting pulp flows out from the discharging outlet 114.

According to the above descriptions, the tool pan assembly of the rubbing machine of the present invention has annular structures that are formed into a plurality of circles, and the annular structures comprise ramps that allow the material to be rubbed to float up into the rubbing zones between the two tool pans effectively so that the material can be rubbed by the alternating forces between the two tool pans. As can be known from this, the rubbing machine of the present invention is applicable to the paper manufacturing industry where the fibers of herbage can be separated effectively by the mechanical force between the two tool pans. Thereby, it is unnecessary to use chemicals and this complies with the modern conception of environmental protection.

Furthermore, the rubbing machine of the present invention can also be used to fibrillate fine fibrils resulting from the separating process to improve the strength and toughness of paper made from the fibers.

What described above are only preferred embodiments of the present disclosure, but are not intended to limit the present disclosure in any form. Although the present disclosure has been described above with reference to the preferred embodiments thereof, the preferred embodiments are not intended to limit the present disclosure. People skilled in the art can make slight alterations or modifications as equivalent embodiments on the basis of the above disclosures without departing from the scope of the present invention. However, any alterations, equivalent changes and modifications made to the above embodiments according to the technical spirits of the present disclosure and without departing from the scope of the present disclosure shall all be covered within the scope of the present disclosure.

INDUSTRIAL APPLICABILITY

The rubbing machine of the present invention is applicable to the paper manufacturing industry where the fibers of herbage can be separated or fibrillated effectively by the mechanical force between the two tool pans. Thereby, it is unnecessary to use chemicals and this complies with the modern conception of environmental protection.

What is claimed is:

1. An rubbing machine, comprising:

a housing, having a feeding inlet and a discharging outlet;

a tool pan assembly, comprising two tool pans arranged inside the housing and spaced apart by an interval to form a rubbing space, the rubbing space communicating between the feeding inlet and the discharging outlet, each of the tool pans comprising a plurality of homocentric annular structures, each of the homocentric annular structures having a plurality of rubbing zones and a plurality of ramps, wherein the ramp depth of each ramp into the tool pan increases radially inward between adjacent rubbing zones in the same homocentric annular structure, and the width of the ramps is gradually smaller from an inner homocentric annular structure to an outer homocentric annular structure; and a driving element, being connected with one of the tool pans to drive the tool pan to rotate relative to the other of the tool pans.

2. The rubbing machine as claimed in claim 1, further comprising a material-guiding screw, wherein one of the tool pans that is not connected with the driving element has a material-guiding hole substantially located at a center of the tool pan, and the material-guiding screw is inserted into the material-guiding hole.

3. The rubbing machine as claimed in claim 1, wherein each of the ramps between the adjacent rubbing zones has a toothed surface.

4. The rubbing machine as claimed in claim 1, wherein each of the rubbing zones has a front end facing towards a direction in which the tool pans rotate relative to each other, and the front end has a chamfer.

5. A tool pan, being connected with a driving element and being driven to rotate by the driving element, the tool pan comprising a plurality of homocentric annular structures, each of the homocentric annular structures having a plurality of rubbing zones and a plurality of ramps, wherein the ramp depth of each ramp into the tool pan increases radially inward between adjacent rubbing zones in the same homocentric annular structure, and the width of the ramps is gradually smaller from an inner homocentric annular structure to an outer homocentric annular structure.

6. The rubbing machine as claimed in claim 5, wherein each of the ramps between the adjacent rubbing zones has a toothed surface.

7. The tool pan as claimed in claim 5, wherein each of the rubbing zones has a front end facing towards a direction in which the tool pan rotates, and the front end has a chamfer.

* * * * *